US005464112A

United States Patent [19]

Guillot

[11] Patent Number: 5,464,112

[45] Date of Patent: Nov. 7, 1995

[54] TAMPER-EVIDENT CLOSURE CAP FOR CONTAINERS

[75] Inventor: Christian Guillot, Maillat, France

[73] Assignee: Crealise Conditionnement Inc. - Crealise Packaging Inc., Rawdon, Canada

[21] Appl. No.: 91,033

[22] Filed: Jul. 14, 1993

[51] Int. Cl.[6] ..... B65D 41/32

[52] U.S. Cl. ..... 215/254; 215/213; 215/225; 215/235; 220/254; 220/339; 222/153.1

[58] Field of Search ..... 215/213, 225, 215/235, 253, 254, 354; 220/254, 259, 266, 270, 339; 222/153

[56] References Cited

U.S. PATENT DOCUMENTS

| | | | |
|---|---|---|---|
| 3,651,992 | 3/1972 | Hazard | 222/153 |
| 4,353,483 | 10/1982 | Pehr | 222/153 |
| 4,487,324 | 12/1984 | Ostrowsky | 215/253 |
| 4,519,517 | 5/1985 | Walter | 215/253 |
| 4,555,038 | 11/1985 | Nagel, Jr. | 215/235 |
| 4,711,372 | 12/1987 | Gach | 222/23 |
| 4,730,745 | 3/1988 | Perry | 215/230 |
| 4,782,964 | 11/1988 | Poore et al. | 215/216 |
| 5,069,367 | 12/1991 | Salmon et al. | 222/153 |
| 5,083,671 | 1/1992 | Hayes | 215/245 |
| 5,092,478 | 3/1992 | La Pierre | 215/256 |
| 5,094,361 | 3/1992 | Dubach | 222/81 |
| 5,123,561 | 6/1992 | Gross | 220/254 |
| 5,141,138 | 8/1992 | Odet et al. | 222/541 |
| 5,147,054 | 9/1992 | Pehr | 215/253 |
| 5,356,018 | 10/1994 | Dubach | 215/237 |

FOREIGN PATENT DOCUMENTS 2657066 7/1991 France .

*Primary Examiner*—Allan N. Shoap
*Assistant Examiner*—Vanessa Caretto
*Attorney, Agent, or Firm*—Foley & Lardner

[57] ABSTRACT

The invention relates to a tamper-evident closure cap for a container having a neck and an opening defined in the neck. The closure cap of the invention includes an annular skirt member adapted to be secured to the neck of the container to prevent removal of the closure cap from the container, and a closure member hingedly connected to the skirt member for pivotal movement between a closed position whereat the closure member closes the opening of the container and an open position whereat the closure member permits access to the opening. A manually graspable tab is fixedly connected to the closure member for moving same from the closed position to the open position. The closure cap further includes a tamper-indicating member removably connected to the skirt member in overlying relation with respect to the tab and adapted to prohibit initial opening of the closure member prior to removal of the tamper indicating member. Thus, unauthorized removal of the tamper-indicating member provides evidence of tampering or initial opening.

19 Claims, 3 Drawing Sheets

TAMPER-EVIDENT CLOSURE CAP FOR CONTAINERS

BACKGROUND OF THE INVENTION

The present invention relates to a safety closure and, more particularly, to a tamper-evident closure cap for containers of the type containing pharmaceutical products.

Millions of dollars are wasted by companies discarding containers with pharmaceutical contents, which have been tampered with. As such containers are generally available to the public in drug stores or pharmacies and are displayed on shelves without supervision, they are often opened by individuals who may alter their content. The tampered containers must then be discarded since they represent a possible hazard to the user.

Applicant has already proposed in French Patent No. 2,657,066 a safety cap for the above type of containers, comprising an annular skirt for attachment to the neck of the container so as to prevent removal of the cap for the container, and a planar closure lid hinged to the skirt for movement between open and closed positions. The closure lid is provided with an outwardly projecting, manually graspable tab enabling one to move the closure lid from the closed position to the open position, the lid and tab being co-planar. A tamper-indicating ring extends between the closure lid and the skirt and is removably connected to both the lid and skirt by a plurality of spaced-apart frangible fingers, the ring having a portion extending about the contour of the tab in spaced relation therefrom to define a handle enabling the ring to be manually grasped and torn away from the cap prior to the initial opening of the lid. Since the closure lid is releasably connected to the skirt via the tamper-indicating ring by frangible fingers, unauthorized removal of such a ring provides evidence of tampering or initial opening.

However, since the handle of the ring extends in the same plane as the tab and closely adjacent thereto, it is possible for an unauthorized user to grasp between his fingers both the handle and tab and to displace the closure lid together with the tamper-indicating ring in a manner such as to break only the frangible fingers which connect the ring to the skirt, thereby opening the lid while the ring remains attached thereto. After having had access to the content of the container, the unauthorized user can then close the lid with the attached ring such as to cause alignment of the broken fingers and provide a visual appearance of intactness, therefore defeating the tamper-indicating feature of the cap.

SUMMARY OF THE INVENTION

It is therefore an object of the present invention to overcome the above drawback and to provide an improved tamper-evident closure cap for containers.

In accordance with the invention, there is provided a tamper-evident closure cap for a container having a neck and an opening defined in the neck, which closure cap comprises an annular skirt member, means for securing the skirt member to the neck of the container to prevent removal of the closure cap from the container and a closure member hingedly connected to the skirt member for pivotal movement between a closed position whereat the closure member closes the opening of the container and an open position whereat the closure member provides access to the opening. The closure cap of the invention further includes opening means for moving the closure member from the closed position to the open position, and a tamper-indicating member removably connected to the skirt member in overlying relation with respect to the opening means and adapted to prohibit initial opening of the closure member prior to removal of the tamper-indicating member. Thus, unauthorized removal of the tamper-indicating member provides evidence of tampering or initial opening.

Since, according to the invention, the tamper-indicating member is disposed in overlying relation with respect to the opening means, it is impossible for an unauthorized user to move the closure member from the closed position to the open position without first removing the tamper-indicating member and thus without providing evidence of tampering or initial opening.

In a preferred embodiment of the invention, the closure member has a top planar portion extending in a first plane and the opening means comprises an outwardly projecting, manually graspable tab integrally formed with the closure member, the tab extending in a second plane parallel to and below the first plane. The tamper-indicating member, on the other hand, comprises a manually graspable tongue portion and two elongated attachment portions each extending from either side of the tongue portion between the closure member and the skirt member, the tongue portion extending parallel to the tab and each attachment portion being detachably connected to the skirt member by first frangible bridging means. Preferably, the tongue portion extends slightly beyond the tab to facilitate manual grasping of same, and it has a configuration such as to substantially completely cover the tab.

According to another preferred embodiment, the attachment portions of the tamper-indicating member extend adjacent the closure member and are each detachably connected thereto by second frangible bridging means defining a weaker connection than the first frangible bridging means. For example, the first frangible bridging means may comprise a plurality of spaced-apart frangible fingers or bridges detachably connecting one side of each attachment portion to the skirt member and the second frangible bridging means may comprise a fewer number of spaced-apart frangible bridges detachably connecting an opposite side of each attachment portion to the closure member.

According to yet another preferred embodiment, the skirt member extends slightly beyond the aforementioned first plane to prevent manipulation of the closure member when the closure member is in the closed position, and a recess is formed in an upper portion of the skirt member for receiving both the tab and tongue portion.

The closure member advantageously includes means for sealing the opening of the container when the closure member is in the closed position.

The closure cap of the invention can be molded in a single piece from a thermoplastic material such as polypropylene, by an injection blow molding process.

BRIEF DESCRIPTION OF THE DRAWINGS

Further features and advantages of the invention will become more readily apparent from the following description of preferred embodiments illustrated by way of example in the accompanying drawings, in which.

DESCRIPTION OF PREFERRED EMBODIMENTS

Figure 1:
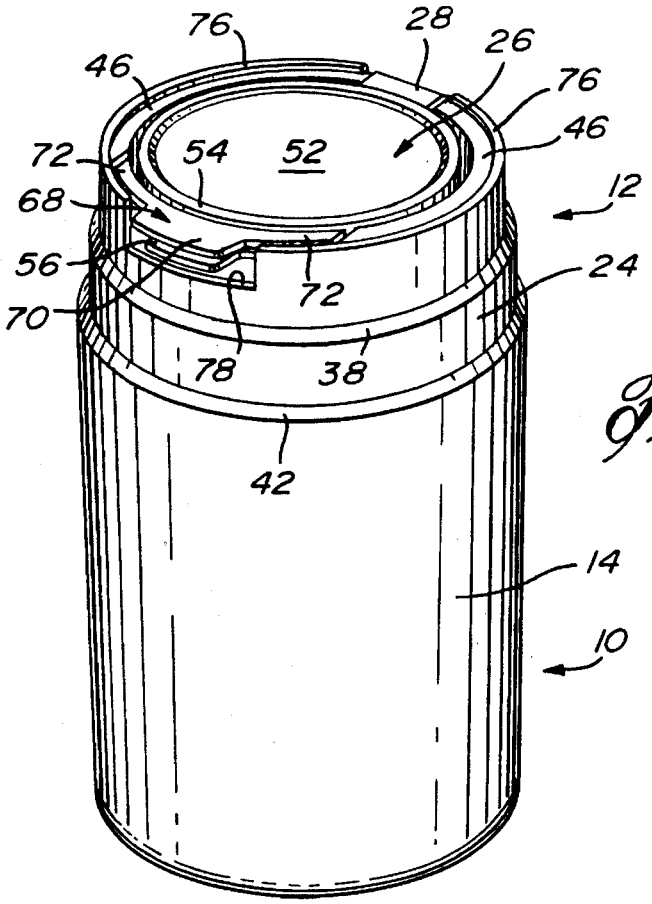
FIG. 1 is a perspective view of a container provided with a tamper-evident closure cap according to a preferred embodiment of the invention.
Figure 2:
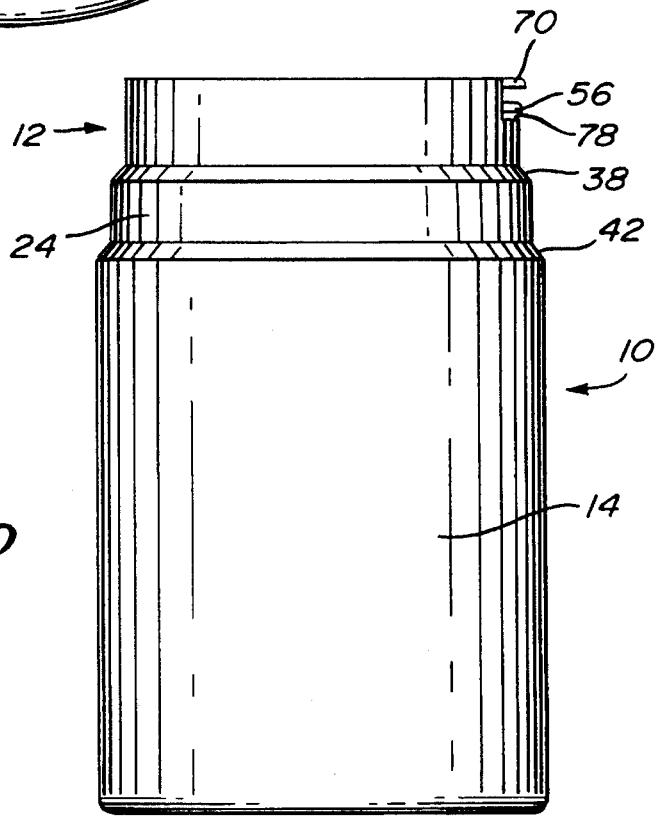
FIG. 2 is a side elevational view of the container and cap assembly shown in FIG. 1.

Referring to FIGS. 1–5 of the drawings, there is illustrated a container 10 provided with a tamper-evident closure cap 12. The container 10 has a body 14 with a neck 16 and a mouth opening 18 defined in the neck. The neck 16 includes an annular shoulder 20 and an outwardly projecting annular flange 22.

Figure 4:
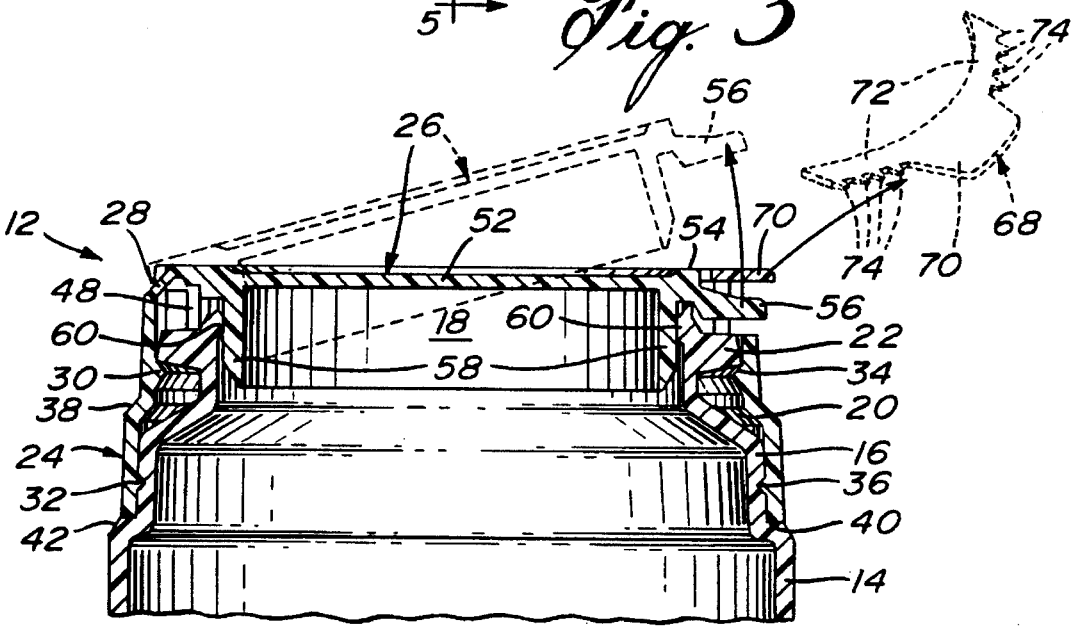
FIG. 4 is a partial sectional view taken along line 4—4 of FIG. 3.
Figure 5:
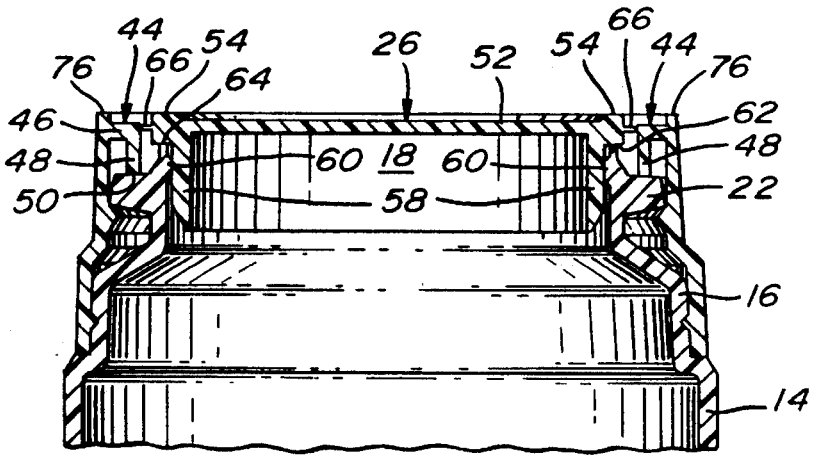
FIG. 5 is a partial sectional view taken along line 5—5 of FIG. 3.

The closure cap 12 comprises an annular skirt member 24 and a closure member 26 which is hingedly connected to the skirt member by a hinge element 28 integrally formed with members 24,26. In order to secure the skirt member 24 to the neck 16 so as to prevent removal of the closure cap 12 from the container 10, the skirt member is provided with two radially inwardly projecting beads 30 and 32, the bead 30 engaging in the annular recess 34 formed underneath the flange 22 and the bead 32 engaging in an annular recess 36 formed in the neck 16 below the recess 34. The skirt member 24 also has an annular shoulder 38 engaging the shoulder 20 of the neck 16. As shown in FIGS. 4 and 5, the lower edge 40 of the skirt member abuts an annular shoulder 42 of the container. A pair of arcuate stop members 44 having an inverted L-shaped cross-section is provided for preventing downward movement of the skirt member 24 relative to the neck 16. The stop members 44 are arranged in opposed spaced-apart relationship with the closure member 26 disposed therebetween. Each stop member comprises a short segment 46 integrally formed with the skirt member and a longer depending segment 48 having an outer end surface 50 abutting the annular flange 22.

The closure member 26 has a top planar portion 52 which is slightly recessed to form a circumferential ring portion 54. A manually graspable tab 56 is integrally formed with the closure member 26 and projects outwardly therefrom to enable one to move the closure member from a closed position whereat the closure member closes the opening 18 of the container to an open position whereat the closure member permits access to the opening 18, the closure member 26 illustrated in broken lines in FIG. 4 being shown partially opened. As also shown in FIG. 4, the tab 56 extends in a plane parallel to and below the plane of the top portion 52. The closure member 26 has an annular inner wall portion 58 depending from the top portion 52 and adapted to be positioned within the opening 18 so as to sealingly engage an annular sealing bead 60 projecting inwardly from the neck 16 and thereby seal the opening 18 when the closure member is in the closed position; as shown in FIG. 5, a lower outer abutment portion 62 of the closure member rests on the upper edge or rim 64 of the neck 16 in the closed position.

Figure 3:
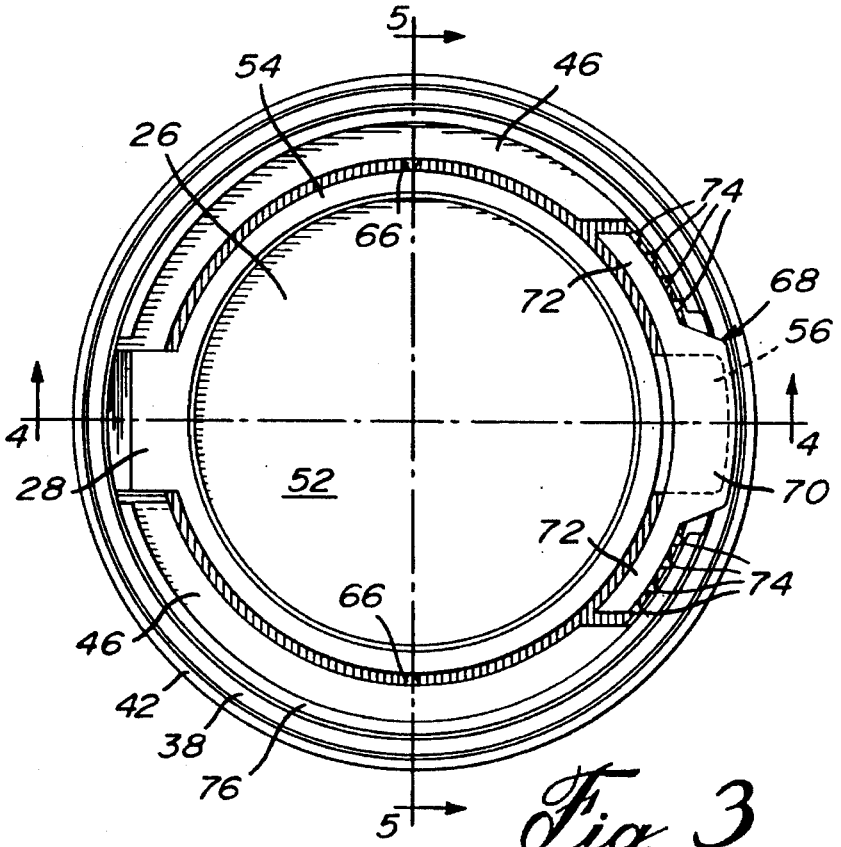
FIG. 3 is a top plan view thereof.

As shown in FIGS. 3 and 5, the closure member 26 is releasably connected to the stop members 44 by a pair of frangible bridges 66 which are diametrically opposed to one another. The segment 46 of each stop member 44 extends generally in the same plane as the top portion 52 of the closure member.

A tamper-indicating member 68 is removably connected to the skirt member 24 in overlying relation with respect to the tab 56 and is adapted to prohibit initial opening of the closure member 26 prior to removal of the member 68. The tamper-indicating member comprises a manually graspable tongue portion 70 and two arcuate attachment portions 72 each extending from either side of the tongue portion 70 between the closure member 26 and the skirt member 24. The tongue portion 70 extends parallel to the tab 56 and each attachment portion 72 is detachably connected to the skirt member 24 by a plurality of spaced-apart frangible bridges 74. The tongue portion 70 and attachment portions 72 are co-planar and extend generally in the same plane as the top portion 52 of the closure member 26. As shown, the tongue portion 70 extends slightly beyond the tab 56 to facilitate manual grasping of same, and it has a configuration such as to substantially completely cover the tab 56.

The skirt member 24 extends upwardly such that the upper edge 76 thereof is disposed at a height slightly above the plane of the top portion 52 of the closure member 26, thereby preventing manipulation of the closure member when it is in the closed position. A notch 78 is formed in an upper portion of the skirt member for receiving the tab 56 and tongue portion 70 of member 68.

Figure 6:
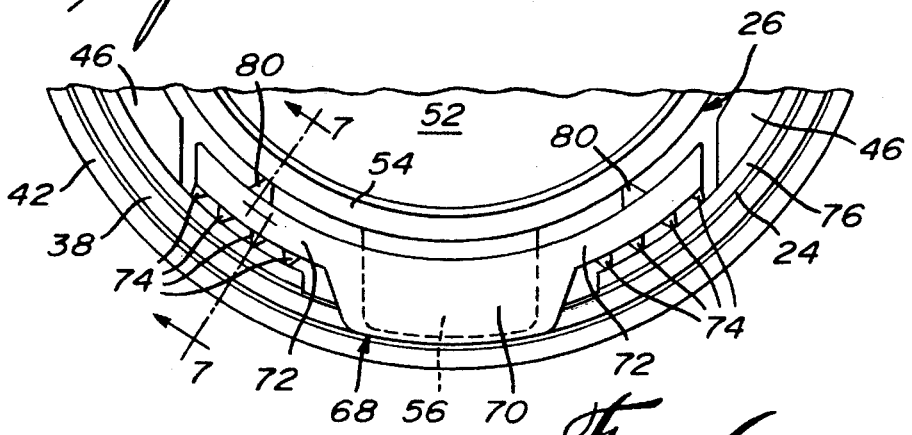
FIG. 6 is a partial top plan view of a container and cap assembly showing another preferred embodiment of the invention.
Figure 7:
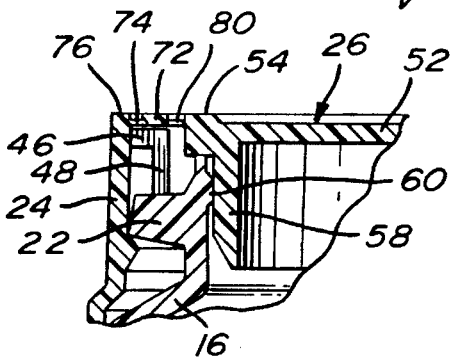
FIG. 7 is a fragmentary sectional view taken along line 7—7 of FIG. 6.

In the embodiment illustrated in FIGS. 6 and 7, the attachment portions 72 of the tamper-indicating member 68, in addition to having one side detachably connected to the skirt member 24 by the frangible bridges 74, each have an opposite side detachably connected to the closure member 26 by a frangible bridge 80. Since there are only two frangible bridges 80 connecting the tamper-indicating member 68 to the closure member 26, as compared to eight frangible bridges 74 connecting the member 68 to the skirt member 24, the frangible bridges 80 define a weaker connection than the frangible bridges 74. This ensures that the tamper-indicating member 68 will separate from the closure member 26 upon lifting the tongue portion 70 to provide clearance for the tab 56, during initial opening of the closure member 26.

Opening of the closure member 26 is effected by first grasping between one's fingers the tongue portion 70 of the tamper-indicating member 68 and exerting an upward force to break the frangible bridges 74 (as well as the frangible bridges 80 in the case of the embodiment shown in FIGS. 6 and 7) so as to remove the member 68. Thereafter, the tab 56 is grasped to move the closure member 26 from the closed position to the open position, as shown in FIG. 3.

Since the tamper-indicating member 68 is disposed in overlying relation with respect to the tab 56, it is impossible for an unauthorized user to move the closure member 26 from the closed position to the open position without first removing the member 68 and thus without providing evidence of tampering or initial opening.

I claim:

1. A tamper-evident closure cap for a container having a neck and an opening defined in said neck, said closure cap comprising:

an annular skirt member;

means for securing said skirt member to the neck of said container to prevent removal of said closure cap from said container;

a closure member hingedly connected to said skirt member for pivotal movement between a closed position whereat said closure member closes the opening of said container and an open position whereat said closure member permits access to said opening, said closure member having a top planar portion extending in a first plane;

opening means for moving said closure member from said closed position to said open position; and a tamper-indicating member removably connected to said skirt member in overlying relation with respect to said opening means for prohibiting initial opening of said closure member prior to removal of said tamper-indicating member, said tamper-indicating member comprising a manually graspable tongue portion, and at least one elongated attachment portion extending between said closure member and said skirt member and being detachably connected to said skirt member, said tongue portion and said at least one attachment portion being co-planar and extending generally in said first plane;

wherein unauthorized removal of said tamper-indicating member provides evidence of tampering or initial opening.

2. A closure cap as claimed in claim 1, wherein said opening means is a grasping means fixedly connected to said closure member.

3. A closure cap as claimed in claim 2, wherein said grasping means comprises an outwardly projecting, manually graspable tab integrally formed with said closure member, said tab extending in a second plane parallel to and below said first plane.

4. A closure cap as claimed in claim 3, wherein said tamper-indicating member comprises two elongated attachment portions each extending from either side of said tongue portion between said closure member and said skirt member, parallel each said attachment portion being detachably connected to said skirt member by first frangible bridging means.

5. A closure cap as claimed in claim 4, wherein said tongue portion extends parallel to and slightly beyond said tab to facilitate manual grasping of same.

6. A closure cap as claimed in claim 5, wherein said tongue portion has a configuration such as to substantially completely cover said tab.

7. A closure cap as claimed in claim 4, wherein said first frangible bridging means comprises a plurality of spaced-apart frangible bridges detachably connecting each said attachment portion to said skirt member.

8. A closure cap as claimed in claim 4, wherein said attachment portions extend adjacent said closure member and are each detachably connected thereto by second frangible bridging means defining a weaker connection than said first frangible bridging means.

9. A closure cap as claimed in claim 8, wherein said first frangible bridging means comprises a plurality of spaced-apart frangible bridges detachably connecting one side of each said attachment portion to said skirt member and wherein said second frangible bridging means comprises a fewer number of spaced-apart frangible bridges detachably connecting an opposite side of each said attachment portion to said closure member.

10. A closure cap as claimed in claim 4, wherein said skirt member extends slightly beyond said first plane to prevent manipulation of said closure member when said closure member is in said closed position, and wherein a recess is formed in an upper portion of said skirt member for receiving said tab and said tongue portion.

11. A closure cap as claimed in claim 3, further including stop means for preventing downward movement of said skirt member relative to the neck of said container.

12. A closure cap as claimed in claim 11, wherein said stop means comprises a pair of elongated stop members arranged in opposed spaced-apart relationship with said closure member disposed therebetween, each stop member being integral with said skirt member and abutting an annular flange of said neck when said closure member is in said closed position.

13. A closure cap as claimed in claim 12, wherein each said stop member has an inverted L-shaped cross-section with a short segment integrally formed with said skirt member and extending generally in said first plane, and a longer depending segment having an outer end surface for abutting engagement with said annular flange.

14. A closure cap as claimed in claim 12, wherein said closure member is releasably connected to said stop members by frangible bridging means.

15. A closure cap as claimed in claim 14, wherein said frangible bridging means comprises a pair of frangible bridges each releasably connecting said closure member to a respective one of said stop members.

16. A closure cap as claimed in claim 15, wherein said frangible bridges are diametrically opposed to one another.

17. A closure cap as claimed in claim 3, wherein said closure member has an annular inner wall portion depending from said top portion and positioned within the opening of said container for sealingly engaging the neck thereof when said closure member is in said closed position.

18. A closure cap as claimed in claim 17, wherein the neck of said container has an inwardly projecting annular sealing bead and wherein said annular inner wall portion of said closure member cooperates with said sealing bead to seal said opening.

19. A closure cap as claimed in claim 1, wherein said closure member is provided with means for sealing the opening of said container when said closure member is in said closed position.

* * * * *

UNITED STATES PATENT AND TRADEMARK OFFICE

CERTIFICATE OF CORRECTION

PATENT NO. : 5,464,112

DATED : November 7, 1995

INVENTOR(S) : GUILLOT

It is certified that error appears in the above-indentified patent and that said Letters Patent is hereby corrected as shown below:

In Column 5, line 33, claim 4, please delete "parallel".

Signed and Sealed this

Ninth Day of April, 1996

Bruce Lehman

*Attest:*

BRUCE LEHMAN

*Attesting Officer*

*Commissioner of Patents and Trademarks*